US012751542B2

(12) United States Patent
Jiang et al.

(10) Patent No.: US 12,751,542 B2
(45) Date of Patent: Oct. 6, 2026

(54) FOLDING TABLE WITH ADJUSTABLE HEIGHTS

(71) Applicant: YIXIANG BLOW MOLDING FURNITURE CO., LTD., Yuyao (CN)

(72) Inventors: Yixiang Jiang, Yuyao (CN); Shangxi Jiang, Yuyao (CN); Jinglei Jiang, Yuyao (CN)

(73) Assignee: YIXIAN BLOW MOLDING FURNITURE CO., LTD., Yuyao (CN)

( * ) Notice: Subject to any disclaimer, the term of this patent is extended or adjusted under 35 U.S.C. 154(b) by 36 days.

(21) Appl. No.: 19/054,856

(22) Filed: Feb. 16, 2025

(65) Prior Publication Data

US 2026/0020666 A1 Jan. 22, 2026

(30) Foreign Application Priority Data

Jul. 19, 2024 (CN) ..... 202410971768.7

(51) Int. Cl.

| | |
|---|---|
| ***A47B 3/00*** | (2006.01) |
| ***A47B 3/02*** | (2006.01) |
| ***A47B 3/091*** | (2006.01) |
| ***A47B 9/18*** | (2006.01) |
| ***A47B 13/02*** | (2006.01) |

(52) U.S. Cl.

CPC ..... *A47B 3/002* (2013.01); *A47B 3/02* (2013.01); *A47B 3/0912* (2013.01); *A47B 9/18* (2013.01); *A47B 13/021* (2013.01); *A47B 2003/025* (2013.01)

(58) Field of Classification Search

CPC ..... A47B 3/002; A47B 3/02; A47B 2003/025; A47B 9/18; A47B 2009/006

See application file for complete search history.

(56) References Cited

U.S. PATENT DOCUMENTS

| | | | | | |
|---|---|---|---|---|---|
| 732,585 | A | * | 6/1903 | Reinhardt | A47B 9/18 108/147.22 |
| 2,398,693 | A | * | 4/1946 | Bureau | A47B 9/08 108/11 |
| 2,683,069 | A | * | 7/1954 | Kimmel | A47B 3/08 108/125 |
| 2,843,437 | A | * | 7/1958 | Dorsey | A47B 9/18 108/19 |
| 4,237,795 | A | * | 12/1980 | Parker | A47B 9/00 108/19 |
| 4,259,909 | A | * | 4/1981 | Belina | A47B 9/00 108/83 |

(Continued)

*Primary Examiner* — Daniel J Rohrhoff

(74) *Attorney, Agent, or Firm* — Platinum Intellectual Property PC

(57) ABSTRACT

The present invention discloses a folding table that can be quickly increased in height, including a first table leg and a second table leg arranged oppositely. The bottom end of the first table leg is provided with a first adjustment bar that can flip to achieve height adjustment, and the bottom end of the second table leg is provided with a second adjustment bar that can flip to achieve height adjustment. By simply flipping the first adjustment bar and the second adjustment bar outward simultaneously to a vertical state, the foldable leg frame can quickly increase in height. Additionally, by providing a locking mechanism, the stability of the folding table is further enhanced.

10 Claims, 10 Drawing Sheets

(56) References Cited

U.S. PATENT DOCUMENTS

| | | | | | |
|---|---|---|---|---|---|
| 4,903,614 | A * | 2/1990 | Johnson | A47B 3/08 | 108/19 |
| 4,960,303 | A * | 10/1990 | York | A47B 3/14 | 297/139 |
| 5,261,334 | A * | 11/1993 | Chevoor | A47B 9/18 | 108/147.19 |
| 7,249,563 | B2 * | 7/2007 | Chen | A47B 13/021 | 248/439 |
| 10,905,231 | B1 * | 2/2021 | Horowitz | A47B 91/02 | |
| 2019/0226633 | A1 * | 7/2019 | Hoyle | F16M 11/16 | |
| 2021/0353049 | A1 * | 11/2021 | James | A47B 9/16 | |
| 2022/0265042 | A1 * | 8/2022 | Berastain | A47B 77/06 | |

* cited by examiner

FOLDING TABLE WITH ADJUSTABLE HEIGHTS

CROSS-REFERENCES TO RELATED APPLICATIONS

This application claims the priority of CN patent application Ser. No. 202410971768.7, entitled "Height-Adjustable Foldable Table Leg Frame and Foldable Table," filed Jul. 19, 2024, which is incorporated herein by reference for all purposes.

TECHNICAL FIELD

The present subject matter is in the field of furniture design and manufacture. More particularly, embodiments of the present subject matter relate to a plastic folding table that renders adjustable heights.

BACKGROUND

A table is one of the indispensable pieces of furniture in daily lives. There is a growing demand for versatile outdoor furniture that can meet the different needs of a user. The existing technology of folding tables allows the table legs to be folded toward the tabletop. After being folded, the volume of the folding table is greatly reduced, making it very suitable for carrying during travel and camping.

Among them, folding tables used outdoors often require adjustments in height due to changes in the usage environment, leading to the frequent need for height adjustment. The existing method for adjusting the height of an outdoor foldable table's tabletop is mostly achieved by setting the four table legs, which support the tabletop, as telescopic tubes to adjust the tabletop's height.

For example, the Chinese Utility Model Patent with application number ZL201020119845.X (Publication No. CN201657967U) discloses a "box-type foldable table," which includes a right tabletop panel, a left tabletop panel, a right table frame, a left table frame, hinge components, table frame connectors, a right upper support tube, a left upper support tube, a right lower support tube, a left lower support tube, a right leg tube, a left leg tube, a right telescopic tube, a left telescopic tube, a right horizontal tube, a left horizontal tube, a right connecting tube, a left connecting tube, an adapter seat, locking components, and a positioning sleeve. The locking components are used to control the movement state of two sets of triangular support structures, which consist of the left leg tube, left upper support tube, and left lower support tube, as well as the right leg tube, right upper support tube, and right lower support tube, to achieve the purpose of folding and unfolding the tabletop. Here, the relative height between the tabletop and the ground is adjusted through the telescopic tube method, which also makes it easy to fold the tabletop for convenient portability.

However, this type of folding table also has shortcomings: when adjusting the height of the tabletop, it is necessary to press and hold the buttons on two table legs located on the same side simultaneously to assist with the adjustment, making it impossible to achieve quick adjustments. Additionally, due to the structural nature of the telescopic rod, the rod used for height adjustment extends into the leg tube and needs to move up and down relative to the leg tube. As a result, there is inevitably a gap between the telescopic rod and the leg tube, leading to wobbling. At the same time, the telescopic rod cannot be additionally supported by a support rod, and since outdoor tables frequently bear weight, the resulting wobbling inevitably affects the stability of the tabletop, thereby impacting the user experience. Therefore, further improvements are still needed.

For this reason, there is a strong need to provide a folding table that enables quick height adjustment while also improving the stability of the folding table.

SUMMARY OF THE SUBJECT MATTER

The first technical problem that this invention aims to solve is to provide a foldable leg frame that enables quick height adjustment through rapid folding, addressing the current state of existing technology.

The second technical problem that this invention aims to solve is to provide a folding table that incorporates this foldable leg frame, addressing the current state of existing technology.

The technical solution adopted by this invention to solve the first technical problem is as follows:

This quickly height-adjustable foldable leg frame includes a first table leg and a second table leg that are arranged oppositely. The bottom end of the first table leg is provided with a first adjustment bar that can flip up and down relative to the first table leg to achieve height adjustment, and the bottom end of the second table leg is provided with a second adjustment bar that can flip up and down relative to the second table leg to achieve height adjustment. The foldable leg frame also includes a first support bar, with one end hinged to the first adjustment bar, and a second support bar, with one end hinged to the second adjustment bar, and the second ends of the first adjustment bar and the second adjustment bar are hinged to each other and can rotate relative to each other.

When both the first adjustment bar and the second adjustment bar flip downward to a vertical position, causing the foldable leg frame to become higher, the first support bar and the second support bar can rotate relative to each other into a straight-line state and jointly support between the first adjustment bar and the second adjustment bar to form a stable structure. Additionally, a locking mechanism is provided between the first support bar and the second support bar to ensure that they always remain in a straight-line state.

To allow the first adjustment bar and the second adjustment bar to be better hinged at the bottom of the first table leg and the second table leg, and to ensure that both the first adjustment bar and the second adjustment bar can be timely restricted after rotating to a vertical position, it is preferable that the bottom end of the first table leg is formed with a first installation slot for the first adjustment bar to be hinged and placed. The outer side of the first installation slot is provided with a first side wall that limits the first adjustment bar from rotating outward after flipping to a vertical state, and a first hinge hole that transversely penetrates the first installation slot is also provided on the first table leg for hinging the first adjustment bar.

The bottom end of the second table leg is formed with a second installation slot for the second adjustment bar to be hinged and placed. The outer side of the second installation slot is provided with a second side wall that limits the second adjustment bar from rotating outward after flipping to a vertical state, and a second hinge hole that transversely penetrates the second installation slot is also provided on the second table leg for hinging the second adjustment bar.

To ensure that the first adjustment bar and the second adjustment bar can be timely restricted after rotating to a horizontal state, it is preferable that the inner side of the first installation slot is provided with a first limit section that restricts the first adjustment bar from continuing to rotate inward after flipping to a horizontal state, and the inner side of the second installation slot is provided with a second limit section that restricts the second adjustment bar from continuing to rotate inward after flipping to a horizontal state.

To enable better hinging between the first support bar and the second support bar while also allowing them to restrict each other after rotating to a set position, it is preferable that the second end of the first support bar is provided with a third installation slot for the second end of the second support bar to be hinged and placed. The bottom of the third installation slot is provided with a bottom wall that limits the second support bar from continuing to rotate after reaching a horizontal state. Additionally, a third hinge hole that transversely penetrates the third installation slot is provided on the first support bar for hinging the second support bar, and a fourth hinge hole that matches the third hinge hole is also provided on the second support bar. A pin shaft is inserted through the third hinge hole and the fourth hinge hole, enabling the first support bar and the second support bar to be rotatably hinged together.

To optimize the overall structure of the locking mechanism, ensuring that it can better lock the first support bar and the second support bar in a straight-line state, it is preferable that the locking mechanism includes a limit slot provided on the end face of the second end of the first support bar, a limit pin that is movably arranged on the second support bar and can be embedded in the limit slot, and a reset component that drives the limit pin to always move toward the limit slot. When both the first adjustment bar and the second adjustment bar flip to a vertical state, the limit pin can be embedded and positioned in the limit slot, ensuring that the first support bar and the second support bar always remain in a straight-line state.

To allow the limit pin to slide more smoothly along the second support bar, it is preferable that the second support bar is provided with a horizontal slot that penetrates through it transversely, allowing the limit pin to move back and forth. The reset component is a tension spring, with both ends respectively connected to the limit pin and the pin shaft.

To enable better fixation between the first table leg and the second table leg, it is preferable that a horizontal bar is provided between the first table leg and the second table leg to secure them together.

The technical solution adopted by this invention to solve the second technical problem is as follows:

This folding table includes a tabletop, and the bottom of the tabletop is provided with the aforementioned foldable leg frame. The foldable leg frame is hinged at the bottom of the tabletop and can form both a vertical support state and a horizontal folded state.

To enable the tabletop to be quickly folded for convenient portability, it is preferable that the tabletop includes a first tabletop and a second tabletop that can rotate relative to each other to form an expanded state or a folded state. The bottom of both the first tabletop and the second tabletop is provided with the aforementioned foldable leg frame. Additionally, a support mechanism is provided between the foldable leg frame and the bottom of the first tabletop and second tabletop to maintain the foldable leg frame in a vertical state, and a locking device is also provided between the first tabletop and the second tabletop to maintain the expanded state.

To ensure that the folding table maintains good strength and stability while reducing costs, it is preferable that the first tabletop and the second tabletop are both injection-molded panels. The bottom of both the first tabletop and the second tabletop is provided with a frame, and the first table leg and the second table leg are both hinged on the frame. The support mechanism is positioned between the frame and the foldable leg frame to provide support.

Compared to existing technology, this invention has the following advantages: By setting a first adjustment bar at the bottom of the first table leg, which can flip up and down relative to the first table leg to achieve height adjustment, and setting a second adjustment bar at the bottom of the second table leg, which can flip up and down relative to the second table leg to achieve height adjustment, along with a first support bar hinged at one end to the first adjustment bar and a second support bar hinged at one end to the second adjustment bar, and by hinging the second ends of the first adjustment bar and the second adjustment bar together to allow relative rotation, the height of the foldable leg frame can be quickly increased simply by flipping the first adjustment bar and the second adjustment bar outward to a vertical state. Additionally, the first support bar and the second support bar can rotate into a straight-line state after the first adjustment bar and the second adjustment bar reach the vertical state, allowing them to jointly support between the first adjustment bar and the second adjustment bar to form a stable support structure. By providing a locking mechanism between the first support bar and the second support bar that ensures they always remain in a straight-line state, the stability of the first adjustment bar and the second adjustment bar under load-bearing conditions is further enhanced. As a result, while enabling quick height adjustment of the foldable leg frame, the invention also ensures that the foldable leg frame maintains good stability, thereby reducing the occurrence of wobbling when the table is in use.

DESCRIPTION OF DRAWINGS

The present subject matter is illustrated by way of example, and not by way of limitation, in the figures of the accompanying drawings and in which.

DETAILED DESCRIPTION

Figure 1:
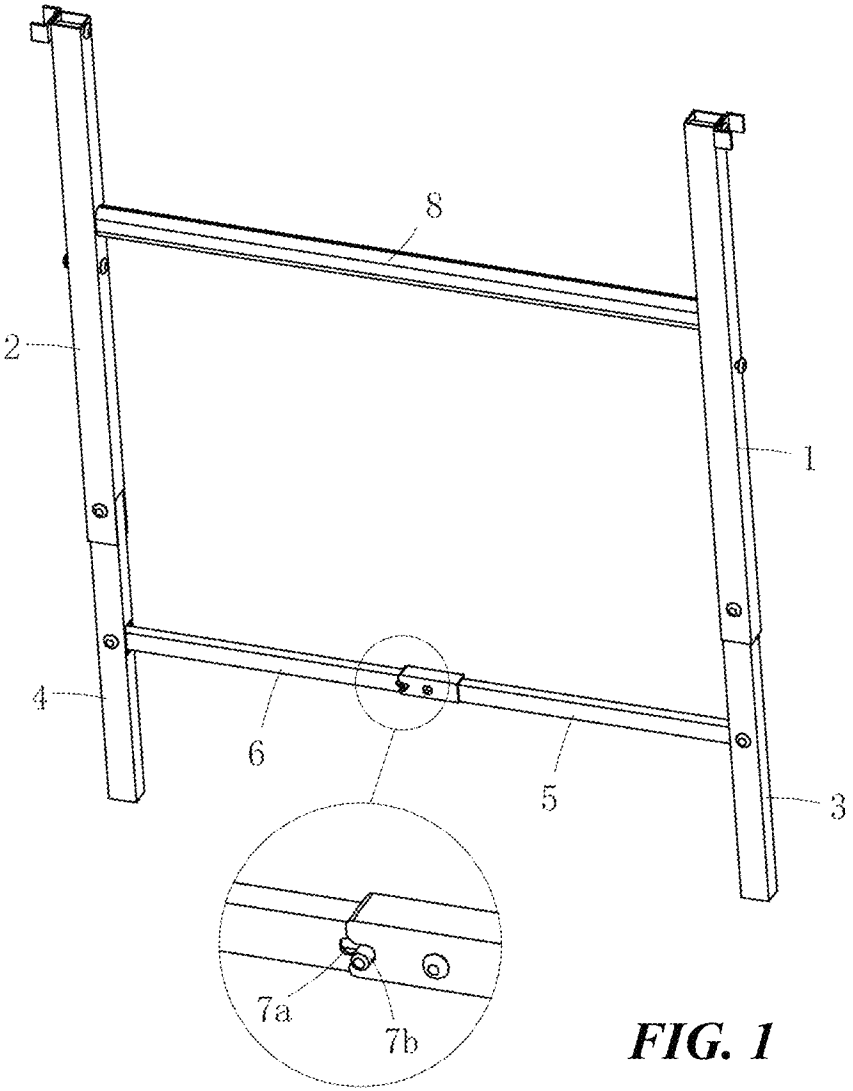
FIG. 1 is a structural schematic diagram of the foldable leg frame in a vertical rotated state in this embodiment.

The present subject matter pertains to improved approaches for a folding table with adjustable legs and heights. Embodiments of the present subject matter are discussed below with reference to FIGS. 1-10.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

The present subject matter will be further described in detail below with reference to the embodiments of the accompanying drawings.

The schematic diagrams shown in FIGS. 1 to 6 represent the foldable leg frame in this embodiment. The quickly height-adjustable foldable leg frame in this embodiment mainly includes a first table leg 1, a second table leg 2, a first adjustment bar 3, a second adjustment bar 4, a first support bar 5, a second support bar 6, and a locking mechanism 7, among others.

Figure 2:
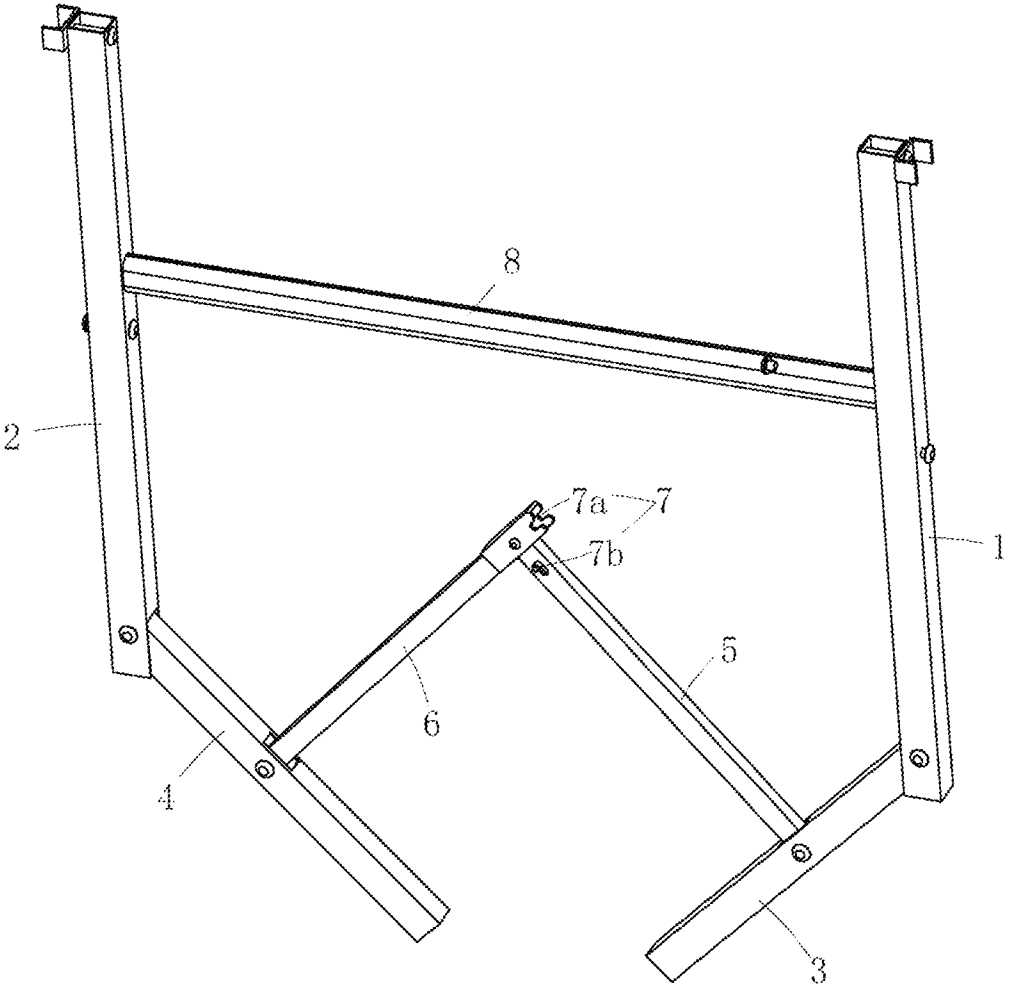
FIG. 2 is a structural schematic diagram of the foldable leg frame rotating from a vertical state to a horizontal state in this embodiment.
Figure 3:
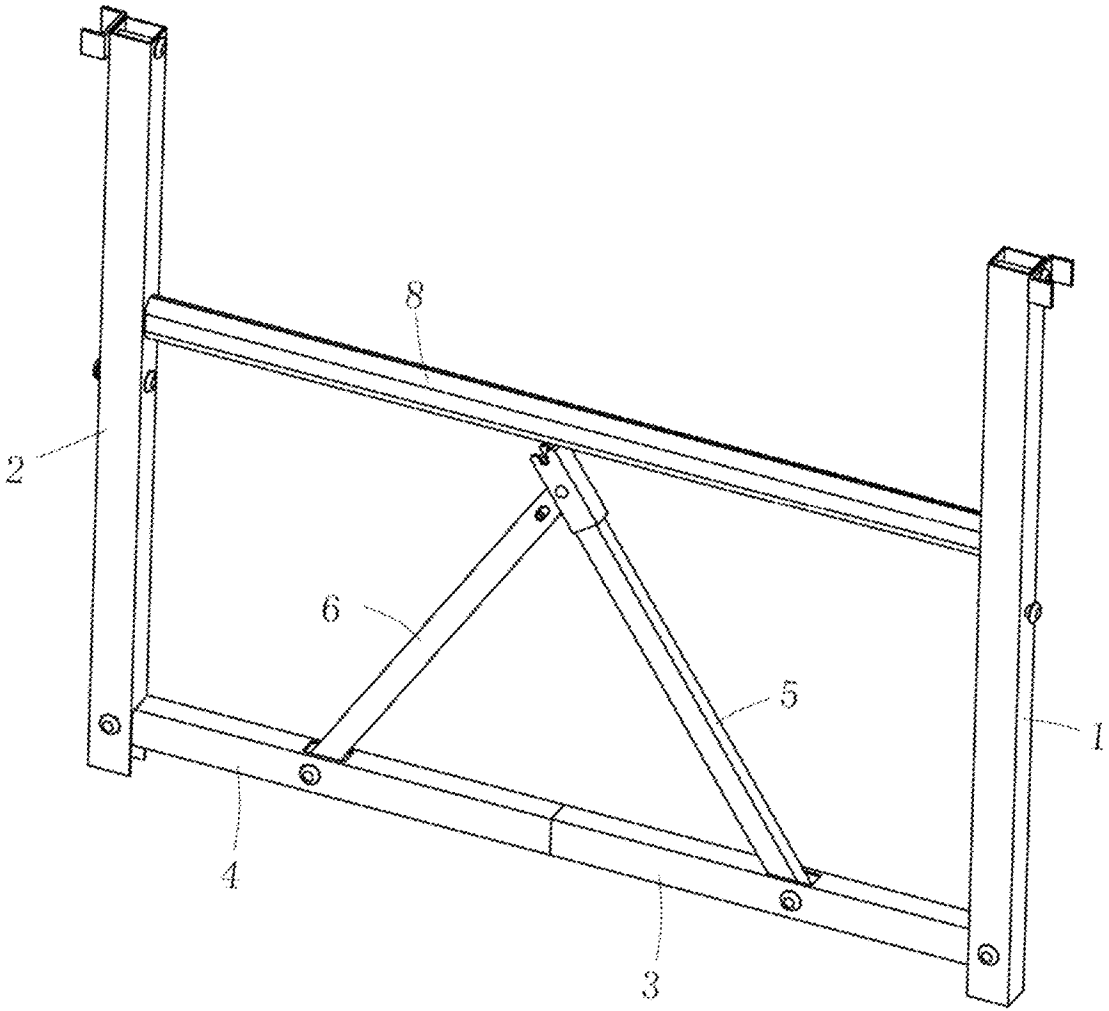
FIG. 3 is a structural schematic diagram of the foldable leg frame in a horizontal rotated state in this embodiment.

Referring to FIGS. 1 to 3, the first adjustment bar 3 is installed at the bottom end of the first table leg 1 and can flip up and down relative to the first table leg 1 to achieve height adjustment. The second adjustment bar 4 is installed at the bottom end of the second table leg 2 and can flip up and down relative to the second table leg 2 to achieve height adjustment. The first end of the first support bar 5 is hinged to the first adjustment bar 3, and the first end of the second support bar 6 is hinged to the second adjustment bar 4. Additionally, the second ends of the first adjustment bar 3 and the second adjustment bar 4 are hinged to each other and can rotate relative to each other. When the first adjustment bar 3 and the second adjustment bar 4 both flip downward to a vertical position, causing the foldable leg frame to increase in height, the first support bar 5 and the second support bar 6 can rotate relative to each other into a straight-line state and jointly support between the first adjustment bar 3 and the second adjustment bar 4 to form a stable structure. Additionally, a locking mechanism 7 is provided between the first support bar 5 and the second support bar 6 to ensure that they always remain in a straight-line state.

Figure 4:
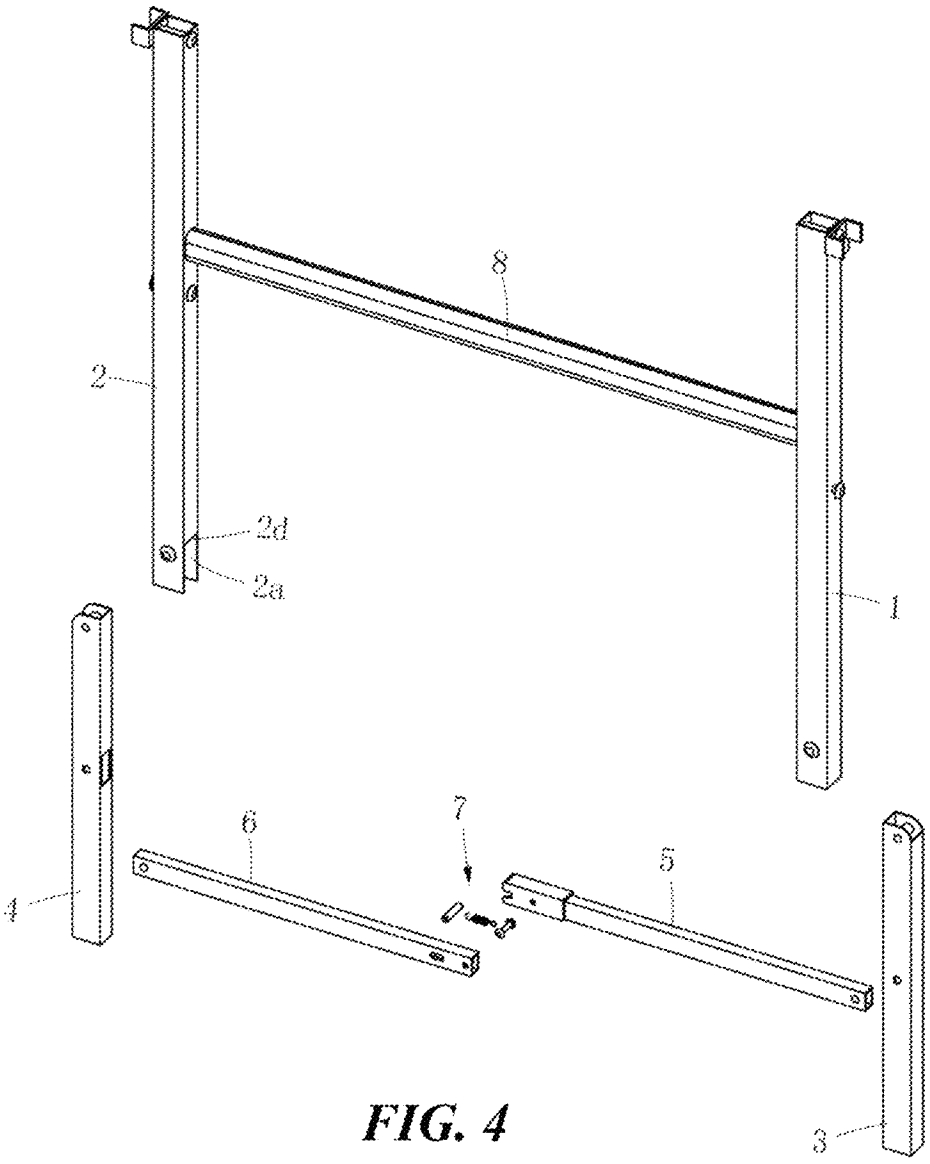
FIG. 4 is a structural schematic diagram of the foldable leg frame in a disassembled state in this embodiment.
Figure 5:
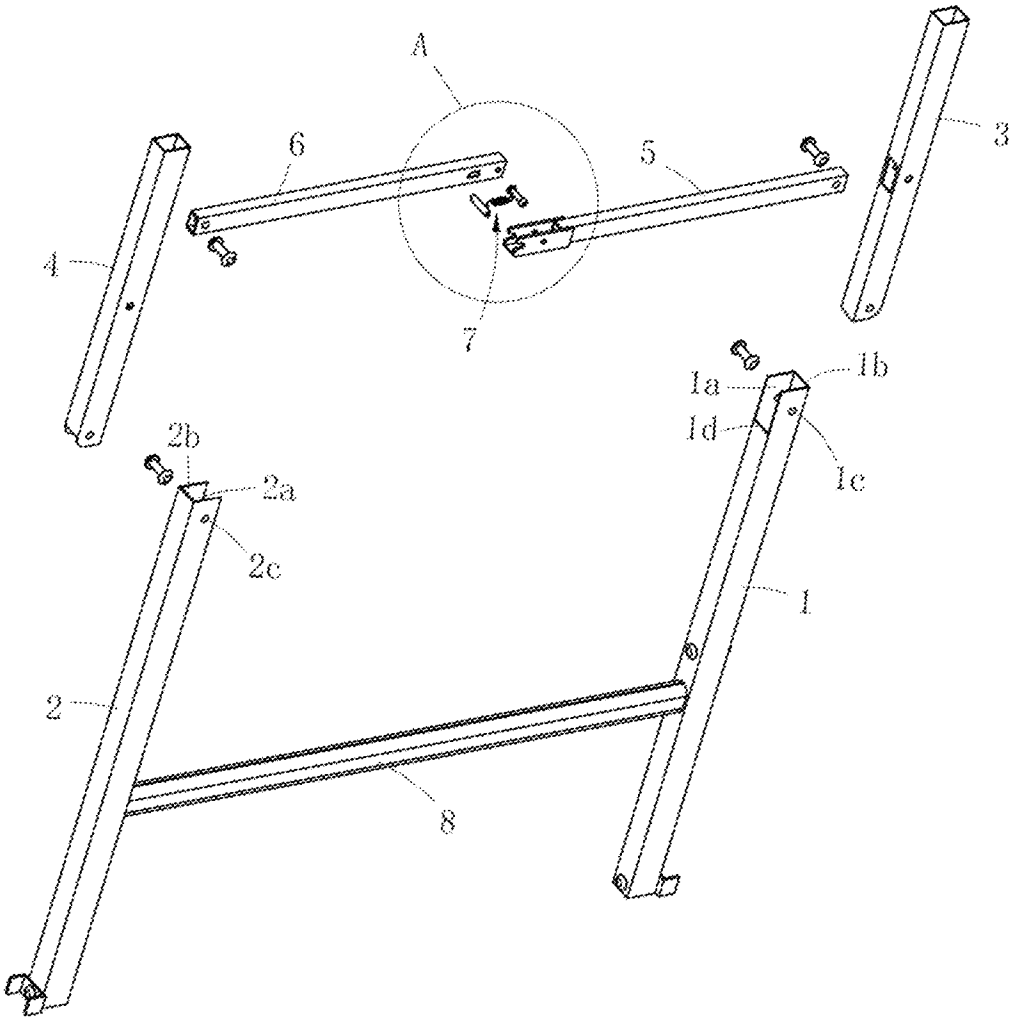
FIG. 5 is a structural schematic diagram of the foldable leg frame in a disassembled state from another angle in this embodiment.

To allow the first adjustment bar 3 and the second adjustment bar 4 to be better hinged at the bottom of the first table leg 1 and the second table leg 2, and to ensure that both the first adjustment bar 3 and the second adjustment bar 4 can be timely restricted after rotating to a vertical position, referring to FIGS. 4 and 5, in this embodiment, a first installation slot 1*a* is specially formed at the bottom end of the first table leg 1 to accommodate the first adjustment bar 3 in a hinged manner. The outer side of the first installation slot 1*a* is provided with a first side wall 1*b* that limits the first adjustment bar 3 from rotating outward after flipping to a vertical state. A first hinge hole 1*c* that transversely penetrates the first installation slot 1*a* is also provided on the first table leg 1 for hinging the first adjustment bar 3. The bottom end of the second table leg 2 is also formed with a second installation slot 2*a* to accommodate the second adjustment bar 4 in a hinged manner. The outer side of the second installation slot 2*a* is provided with a second side wall 2*b* that limits the second adjustment bar 4 from rotating outward after flipping to a vertical state. A second hinge hole 2*c* that transversely penetrates the second installation slot 2*a* is also provided on the second table leg 2 for hinging the second adjustment bar 4.

Next, to ensure that the first adjustment bar 3 and the second adjustment bar 4 can be timely restricted after rotating to a horizontal state, referring to FIGS. 4 and 5, in this embodiment, the inner side of the first installation slot 1*a* is specifically formed with a first limit section 1*d* that restricts the first adjustment bar 3 from continuing to rotate inward after flipping to a horizontal state. Similarly, the inner side of the second installation slot 2*a* is formed with a second limit section 2*d* that restricts the second adjustment bar 4 from continuing to rotate inward after flipping to a horizontal state.

Figure 6:
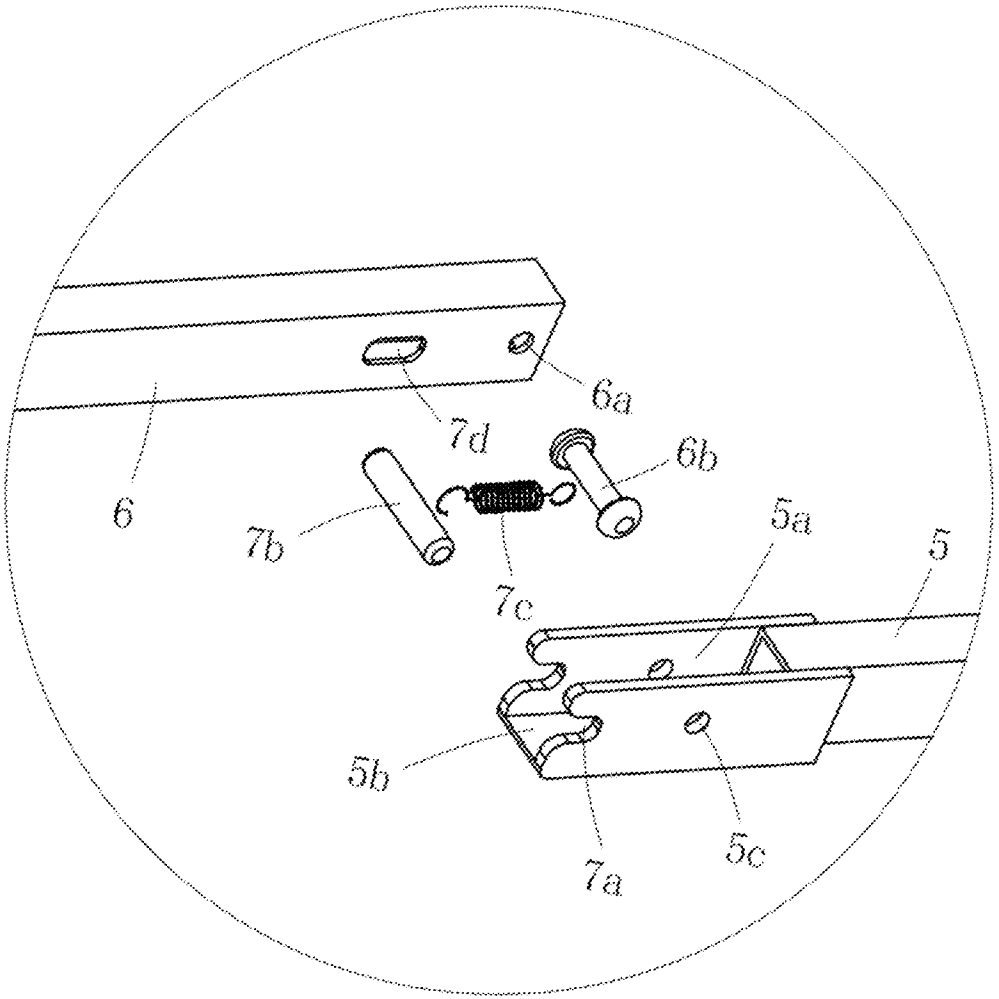
FIG. 6 is an enlarged view of section A in FIG. 5.

Additionally, to enable better hinging between the first support bar 5 and the second support bar 6 while also allowing them to restrict each other after rotating to a set position, referring to FIGS. 5 and 6, in this embodiment, the second end of the first support bar 5 is formed with a third installation slot 5*a* to accommodate the second end of the second support bar 6 in a hinged manner. The bottom of the third installation slot 5*a* is provided with a bottom wall 5*b* that limits the second support bar 6 from continuing to rotate after reaching a horizontal state. Additionally, a third hinge hole 5*c* that transversely penetrates the third installation slot 5*a* is provided on the first support bar 5 for hinging the second support bar 6. A fourth hinge hole 6*a* that matches the third hinge hole 5*c* is also provided on the second support bar 6. A pin shaft 6*b* is inserted through the third hinge hole 5*c* and the fourth hinge hole 6*a*, enabling the first support bar 5 and the second support bar 6 to be rotatably hinged together.

Furthermore, to optimize the overall structure of the locking mechanism 7 and ensure that it can better lock the first support bar 5 and the second support bar 6 in a straight-line state, referring to FIG. 6, the locking mechanism 7 includes a limit slot 7*a* provided on the end face of the second end of the first support bar 5, a limit pin 7*b* that is movably arranged on the second support bar 6 and can be embedded in the limit slot 7*a*, and a reset component 7*c* that drives the limit pin 7*b* to always move toward the limit slot 7*a*. When both the first adjustment bar 3 and the second adjustment bar 4 flip to a vertical state, the limit pin 7*b* can be embedded and positioned in the limit slot 7*a*, ensuring that the first support bar 5 and the second support bar 6 always remain in a straight-line state.

Meanwhile, to allow the limit pin 7*b* to slide more smoothly along the second support bar 6, referring to FIG. 6, in this embodiment, the second support bar 6 is also transversely provided with a horizontal slot 7*d* that allows the limit pin 7*b* to move back and forth. The reset component 7*c* is a tension spring, with both ends respectively connected to the limit pin 7*b* and the pin shaft 6*b*.

In this embodiment, to enable better fixation between the first table leg 1 and the second table leg 2, referring to FIG. 1, a horizontal bar 8 is provided between the first table leg 1 and the second table leg 2 to secure them together.

Figure 7:
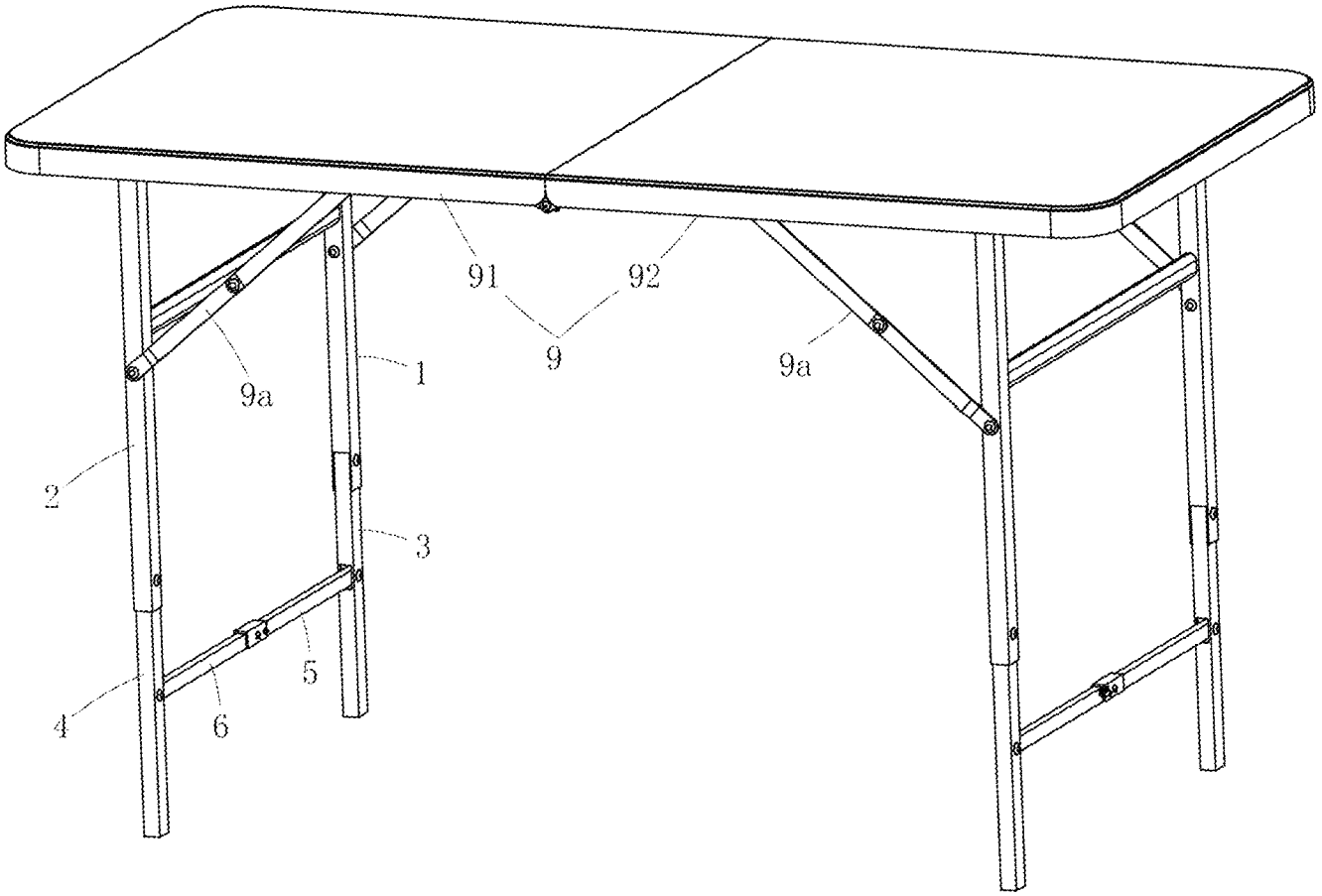
FIG. 7 is a structural schematic diagram of the folding table in this embodiment (with the tabletop in a raised state)
Figure 8:
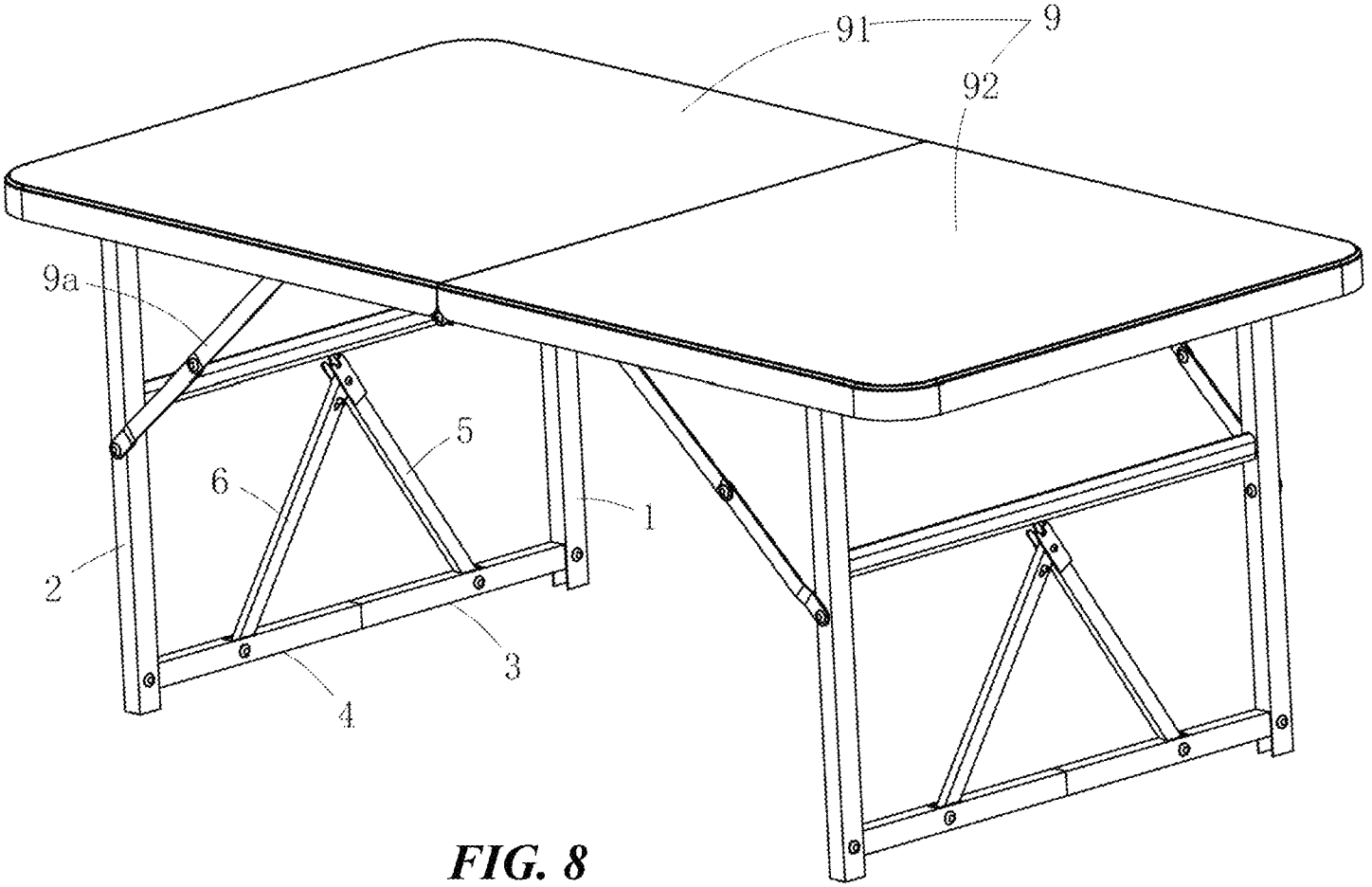
FIG. 8 is a structural schematic diagram of the folding table in this embodiment (with the tabletop in a lowered state)

Additionally, this embodiment also provides a folding table, as specifically shown in FIGS. 7 to 10. The folding table includes a tabletop 9 and a foldable leg frame. The tabletop 9 can be a conventional dual-panel tabletop or a single integrated tabletop. The foldable leg frame is hingedly installed at the bottom of the tabletop 9 and can form both a vertical support state and a horizontal folded state. FIG. 7 shows the structural schematic of the folding table with the tabletop in a raised state, while FIG. 8 shows the structural schematic of the folding table with the tabletop in a lowered state.

Figure 9:
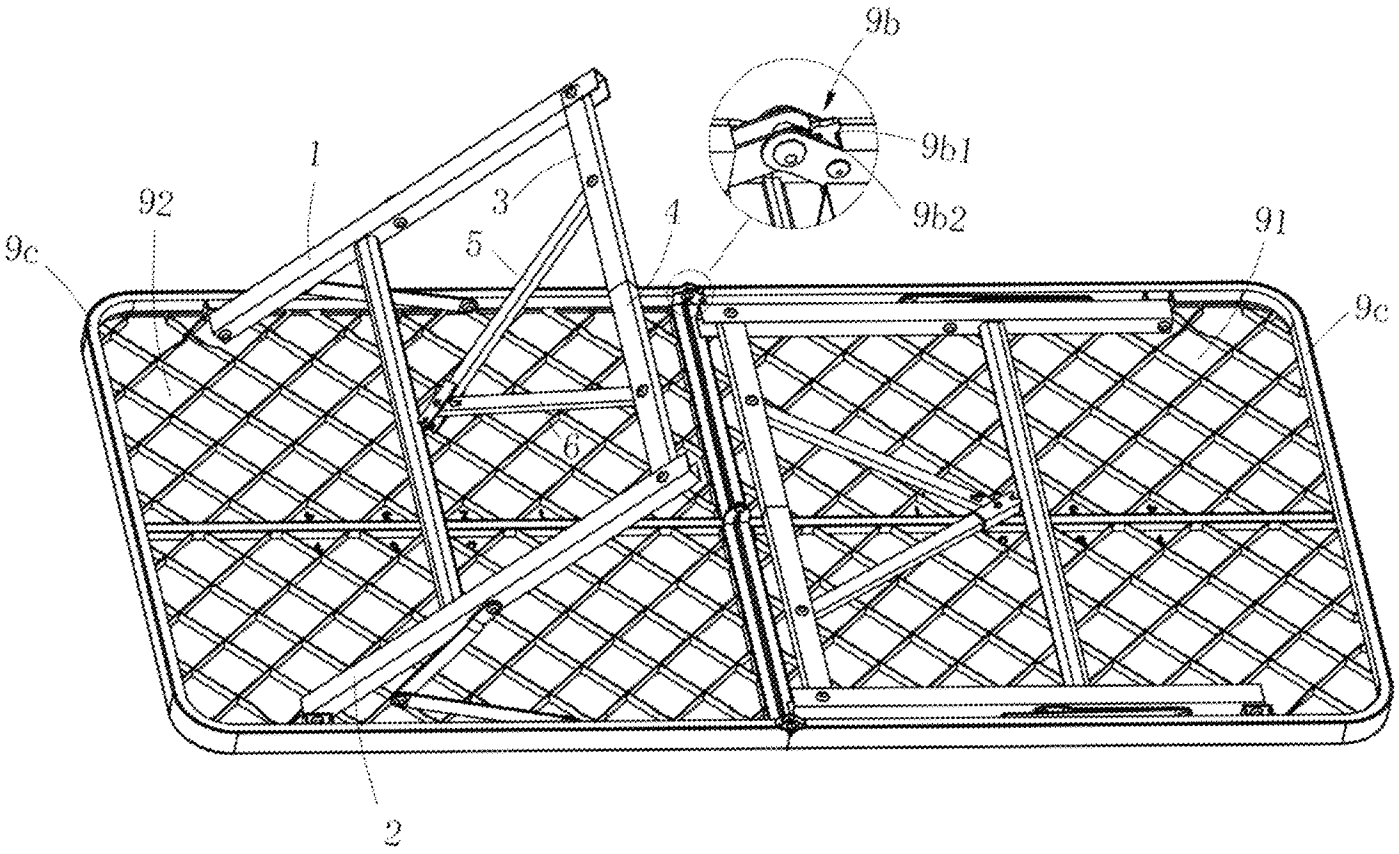
FIG. 9 is a structural schematic diagram of the foldable leg frame in a folded state in this embodiment.
Figure 10:
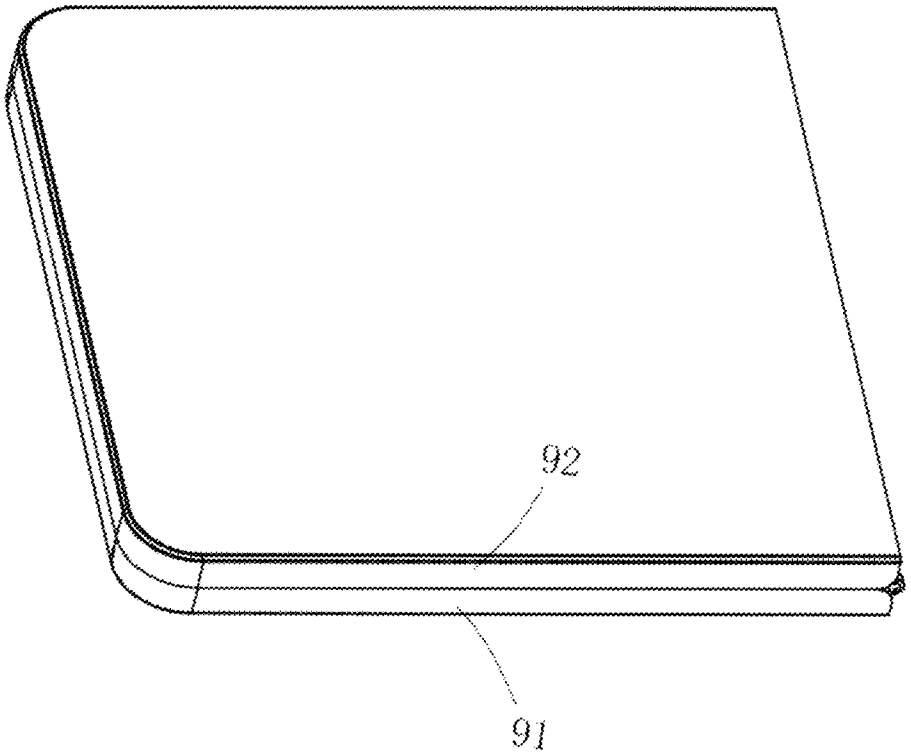
FIG. 10 is a structural schematic diagram of the folding table with both tabletop panels in a folded state in this embodiment.

In this embodiment, to allow the tabletop 9 to be quickly folded for convenient portability, referring to FIGS. 9 and 10, the tabletop 9 includes a first tabletop 91 and a second tabletop 92 that can rotate relative to each other to form an expanded state or a folded state. The bottom of both the first tabletop 91 and the second tabletop 92 is provided with the aforementioned foldable leg frame. Additionally, a support mechanism 9*a* is provided between the foldable leg frame and the bottom of the first tabletop 91 and second tabletop 92 to maintain the foldable leg frame in a vertical state. A locking device 9*b* is also provided between the first tabletop 91 and the second tabletop 92 to maintain the expanded state.

In this embodiment, to ensure that the folding table maintains good strength and stability while reducing costs, referring to FIG. 9, the first tabletop 91 and the second tabletop 92 are both injection-molded panels. The bottom of both the first tabletop 91 and the second tabletop 92 is provided with a frame 9*c*, which is embedded along the outer edges of the first tabletop 91 and the second tabletop 92. The frame 9*c* is primarily made of high-strength materials such as metal to enhance the overall strength of the first tabletop 91 and the second tabletop 92. The first table leg 1 and the second table leg 2 are hingedly installed on the frame 9*c*, and the support mechanism 9*a* is positioned between the frame 9*c* and the foldable leg frame to provide support.

Additionally, in this embodiment, by setting a first adjustment bar 3 at the bottom end of the first table leg 1, which can flip up and down relative to the first table leg 1 to achieve height adjustment, and a second adjustment bar 4 at the bottom end of the second table leg 2, which can flip up and down relative to the second table leg 2 to achieve height adjustment, and by further setting a first support bar 5 with one end hinged to the first adjustment bar 3 and a second support bar 6 with one end hinged to the second adjustment bar 4, as well as hinging the second ends of the first adjustment bar 3 and the second adjustment bar 4 to each other so that they can rotate relative to each other, when it is necessary to increase the height of the foldable leg frame, it can be quickly increased simply by flipping the first adjustment bar 3 and the second adjustment bar 4 outward simultaneously to a vertical state. Since the first support bar 5 and the second support bar 6 can also rotate synchronously into a straight-line state after the first adjustment bar 3 and the second adjustment bar 4 rotate to the vertical state, they can jointly support between the first adjustment bar 3 and the second adjustment bar 4, allowing the first adjustment bar 3 and the second adjustment bar 4 to form a stable supporting structure. Additionally, by providing a locking mechanism 7 between the first support bar 5 and the second support bar 6 that ensures the first support bar 5 and the second support bar 6 always remain in a straight-line state, the stability of the first adjustment bar 3 and the second adjustment bar 4 under load-bearing conditions is further enhanced. As a result, while enabling the foldable leg frame to be quickly increased in height, it also ensures that the foldable leg frame maintains good stability, reducing the occurrence of wobbling when the table is in use. One more point: To achieve better compatibility and facilitate individual shaping, the first table leg 1, the second table leg 2, the first adjustment bar 3, the second adjustment bar 4, the first support bar 5, and the second support bar 6 are all made of square tubes.

It should be noted that, in the description of this embodiment, the terms "front," back," "left, right," "up, down," and other directional or positional relationships are based on the orientations or positional relationships shown in the accompanying drawings. These are merely for the convenience of describing this invention and simplifying the description, and are not intended to indicate or imply that the referred devices or components must have specific orientations, be constructed, or operated in specific orientations. Therefore, these terms should not be understood as limitations on this invention.

The terms "installation," "connection," and "hinge" should be interpreted broadly. For example, they may refer to fixed connections, detachable connections, or integral connections; they may refer to direct connections or indirect connections through an intermediary; they may also refer to communication between internal components of two elements. For those skilled in the field, the specific meanings of the above terms in this invention can be understood according to actual circumstances.

Having disclosed exemplary embodiments and the best mode, modifications and variations may be made to the disclosed embodiments while remaining within the scope of the embodiments of the subject matter as defined by the following claims.

What is claimed is:

1. A foldable table leg frame with adjustable heights, comprising:

a first table leg (1) and a second table leg (2) arranged opposite each other;

a first adjustment bar (3) hingedly connected to a bottom end of the first table leg (1), the first adjustment bar (3) being configured to flip up and down relative to the first table leg (1) to achieve height adjustment;

a second adjustment bar (4) hingedly connected to a bottom end of the second table leg (2), the second adjustment bar (4) being configured to flip up and down relative to the second table leg (2) to achieve height adjustment;

a first support bar (5) having a first end hinged to the first adjustment bar (3);

a second support bar (6) having a first end hinged to the second adjustment bar (4), the second end of the first support bar (5) and the second end of the second support bar (6) being hinged to each other such that the first support bar (5) and the second support bar (6) are rotatable relative to each other, wherein, when the first adjustment bar (3) and the second adjustment bar (4) are flipped downward to a vertical state, the first support bar (5) and the second support bar (6) rotate into a straight-line state and jointly support between the first adjustment bar (3) and the second adjustment bar (4) to form a stable structure, and a locking mechanism (7) disposed between the first support bar (5) and the second support bar (6) to retain the first support bar (5) and the second support bar (6) in the straight-line state.

2. The foldable table leg frame of claim 1, wherein the bottom end of the first table leg (1) defines a first installation slot (la) for hinged placement of the first adjustment bar (3), an outer side of the first installation slot (la) includes a first side wall (1*b*) that limits outward rotation of the first adjustment bar (3) after reaching the vertical state, and the first table leg (1) further defines a first hinge hole (1*c*) transversely penetrating the first installation slot (la) for hinging the first adjustment bar (3), and wherein the bottom end of the second table leg (2) defines a second installation slot (2*a*) for hinged placement of the second adjustment bar (4), an outer side of the second installation slot (2*a*) includes a second side wall (2*b*) that limits outward rotation of the second adjustment bar (4) after reaching the vertical state, and the second table leg (2) further defines a second hinge hole (2*c*) transversely penetrating the second installation slot (2*a*) for hinging the second adjustment bar (4).

3. The foldable table leg frame of claim 2, wherein an inner side of the first installation slot (la) defines a first limit section (1*d*) that restricts inward rotation of the first adjustment bar (3) after reaching a horizontal state, and an inner side of the second installation slot (2*a*) defines a second limit section (2*d*) that restricts inward rotation of the second adjustment bar (4) after reaching a horizontal state.

4. The foldable table leg frame of claim 1, wherein a second end of the first support bar (5) defines a third installation slot (5*a*) for hinged placement of a second end of the second support bar (6), a bottom of the third installation slot (5*a*) includes a bottom wall (5*b*) that limits rotation of the second support bar (6) after reaching a horizontal state, the first support bar (5) defines a third hinge hole (5*c*) transversely penetrating the third installation slot (5*a*) for hinging the second support bar (6), the second support bar (6) defines a fourth hinge hole (6*a*) aligned with the third hinge hole (5*c*), and a pin shaft (6*b*) extends through the third hinge hole (5*c*) and the fourth hinge hole (6*a*) to rotatably hinge the first support bar (5) and the second support bar (6) together.

5. The foldable table leg frame of claim 1, wherein the locking mechanism (7) comprises a limit slot (7*a*) provided on an end face of the second end of the first support bar (5), a limit pin (7*b*) movably arranged on the second support bar (6) and configured to be embedded in the limit slot (7*a*), and a reset component (7*c*) that biases the limit pin (7*b*) toward the limit slot (7*a*), wherein, when the first adjustment bar (3) and the second adjustment bar (4) are flipped to the vertical state, the limit pin (7*b*) engages the limit slot (7*a*) to retain the first support bar (5) and the second support bar (6) in the straight-line state.

6. The foldable table leg frame of claim 5, wherein the second support bar (6) defines a horizontal slot (7*d*) through which the limit pin (7*b*) is movable, and wherein the reset component (7*c*) comprises a tension spring having opposite ends respectively connected to the limit pin (7*b*) and the pin shaft (6*b*).

7. The foldable table leg frame of claim 1, further comprising a horizontal bar (8) extending between and secured to the first table leg (1) and the second table leg (2).

8. A folding table, comprising:

a tabletop (9), and the foldable table leg frame of claim 1 mounted to a bottom of the tabletop (9), wherein the foldable table leg frame is configurable between a vertical support state and a horizontal folded state.

9. The folding table of claim 8, wherein the tabletop (9) comprises a first tabletop (91) and a second tabletop (92) rotatable relative to each other between an expanded state and a folded state, the foldable table leg frame being mounted to bottoms of both the first tabletop (91) and the second tabletop (92), a support mechanism (9*a*) extending between the foldable table leg frame and the bottoms of the first tabletop (91) and the second tabletop (92) to maintain the foldable leg frame in the vertical state, and a locking device (9*b*) extending between the first tabletop (91) and the second tabletop (92) to maintain the expanded state.

10. The folding table of claim 9, wherein the first tabletop (91) and the second tabletop (92) each comprise an injection-molded panel, a frame (9*c*) embedded along outer edges of the first tabletop (91) and the second tabletop (92), the frame (9*c*) being primarily composed of high-strength material to reinforce the first tabletop (91) and the second tabletop (92), the first table leg (1) and the second table leg (2) being hingedly mounted to the frame (9*c*), and the support mechanism (9*a*) being disposed between the frame (9*c*) and the foldable table leg frame.

* * * * *